US005989298A

United States Patent [19]

Lehmann

[11] Patent Number: 5,989,298

[45] Date of Patent: Nov. 23, 1999

[54] MIXTURES OF REACTIVE DYES AND THEIR USE

[75] Inventor: Urs Lehmann, Basel, Switzerland

[73] Assignee: Ciba Speciality Chemicals Corporation, Tarrytown, N.Y.

[21] Appl. No.: 09/156,925

[22] Filed: Sep. 18, 1998

Related U.S. Application Data

[63] Continuation-in-part of application No. 09/050,280, Mar. 30, 1998, Pat. No. 5,849,887.

[30] Foreign Application Priority Data

Apr. 7, 1997 [CH] Switzerland ..... 806/97
Jun. 30, 1998 [DE] Germany ..... 98810607

[51] Int. Cl.[6] ..... C09B 67/22; D06P 1/38

[52] U.S. Cl. ..... 8/549; 8/543

[58] Field of Search ..... 8/543, 549

[56] References Cited

U.S. PATENT DOCUMENTS

| | | | |
|---|---|---|---|
| 3,558,592 | 1/1971 | de Montmollin | 260/199 |
| 3,923,778 | 12/1975 | De Montmollin et al. | 534/643 |
| 4,885,360 | 12/1989 | Scheibli | 534/642 |
| 4,917,705 | 4/1990 | Mäusezahl et al. | 8/540 |
| 5,391,718 | 2/1995 | Tzikas et al. | 534/632 |
| 5,445,654 | 8/1995 | Hussong et al. | 8/546 |
| 5,554,733 | 9/1996 | Tzikas et al. | 534/638 |
| 5,565,553 | 10/1996 | Deitz et al. | 534/612 |
| 5,611,821 | 3/1997 | Huang et al. | 8/549 |
| 5,629,410 | 5/1997 | Deitz et al. | 534/642 |
| 5,684,138 | 11/1997 | Klier et al. | 534/612 |
| 5,690,698 | 11/1997 | Von Der Eltz et al. | 8/532 |
| 5,780,602 | 7/1998 | Schumacher et al. | 534/642 |

FOREIGN PATENT DOCUMENTS

| | | |
|---|---|---|
| 0063276 | 10/1982 | European Pat. Off. . |
| 0122600 | 10/1984 | European Pat. Off. . |
| 735112 | 10/1996 | European Pat. Off. . |
| 785237 | 7/1997 | European Pat. Off. . |
| 2032927 | 1/1972 | Germany . |
| 3113989 | 11/1982 | Germany . |
| 1349168 | 3/1974 | United Kingdom . |

OTHER PUBLICATIONS

Chem. Abst. 125:303252z, 1996.

Derwent Abstr. 96–018304/02 and English translation for KR 9402650, Mar. 25, 1994.

Derwent Abstr. 95168 E/45 for DE 3113989.

Derwent Abstr. 90574 E/43 for DE 3113885.

Byczynska et al., Chemical Abstracts, 91:124878r, 1979.

*Primary Examiner*—Fiona T. Powers
*Attorney, Agent, or Firm*—Kevin T. Mansfields

[57] ABSTRACT

Dye mixtures, which comprise at least one reactive dye of formulae (1) and (2)

(1)

and (2)

, (4)

, (5)

and

-continued
(6)
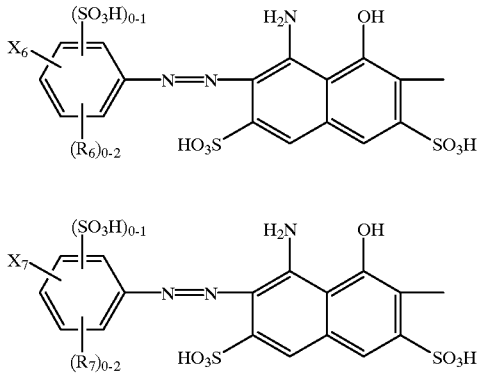
-continued
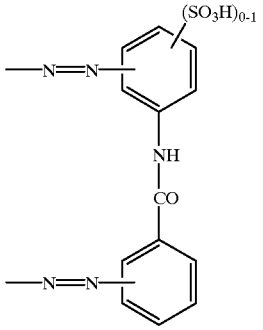
,
wherein B, $D_1$, $D_2$, $(R_1)_{0-2}$, $R_3$, $R_4$, $(R_5)_{0-2}$, $(R_6)_{0-2}$, $(R_7)_{0-2}$, p, q, V, $X_1$, $X_2$, $X_3$, $X_4$, $X_5$, $X_6$, $X_7$, $Y_1$ and $Y_3$ have the meanings defined in claim 1, give dyeings of good fastness properties on nitrogen-containing or hydroxyl group-containing fiber materials.
20 Claims, No Drawings

MIXTURES OF REACTIVE DYES AND THEIR USE

This is a continuation-in-part of application Ser. No. 09/050,280 filed Mar. 30, 1998.

The present invention relates to mixtures of reactive dyes which are particularly suitable for dyeing or printing nitrogen-containing or hydroxyl group-containing fibre materials and which give dyeings or prints having good all around fastness properties.

This invention therefore relates to dye mixtures, which comprise at least one reactive dye of formulae (1) and (2)

(1)

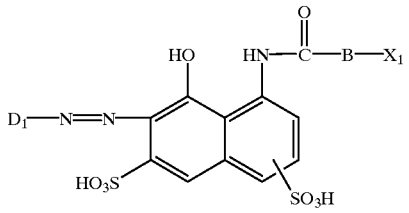

and (2)

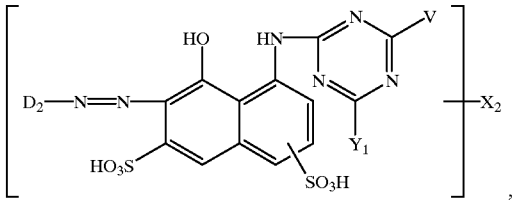

wherein

B is a radical of the benzene series, $D_1$ and $D_2$ are each independently of the other a radical of the benzene or naphthalene series, V is unsubstituted or substituted amino, $X_1$ and $X_2$ are each independently of the other a fibre-reactive radical of formula —NH—CO—CH(Hal)—$CH_2$Hal (3a) or —NH—CO—C(Hal)=$CH_2$ (3b), wherein Hal is halogen, and $Y_1$ is halogen;

together with at least one reactive dye of formulae (4), (5) and (6)

(4)

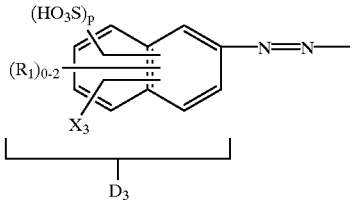

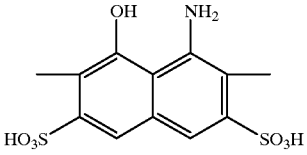

-continued

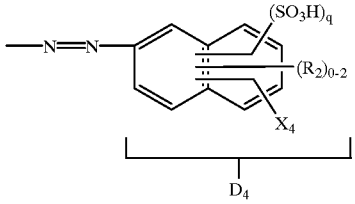

wherein $(R_1)_{0-2}$ and $(R_2)_{0-2}$ are each independently of one another 0 to 2 identical or different substituents selected from the group consisting of $C_1$–$C_4$alkyl and $C_1$–$C_4$alkoxy, p and q are each independently of the other the number 0, 1 or 2, $X_3$ and $X_4$ are each independently of the other hydrogen or a fibre-reactive radical of formula (3a), (3b), (3c), (3d) or (3e)

(3a)

—NH—CO—CH(Hal)—$CH_2$Hal, (3b)

—NH—CO—C(Hal)=$CH_2$, (3c)

—$SO_2$—Z, (3d)

—CO—NH—$(CH_2)_{2-3}$—$SO_2$—Z or (3e)

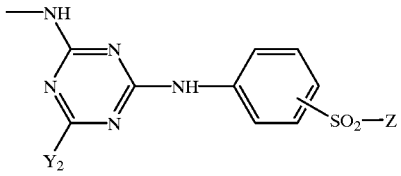

and Hal and $Y_2$ are halogen, Z is a radical of formula —$CH_2CH_2$—U or —CH=$CH_2$, and U is a leaving group (5)

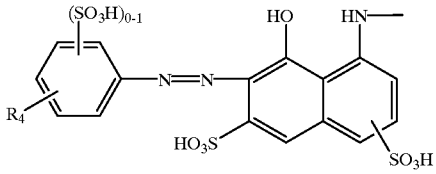

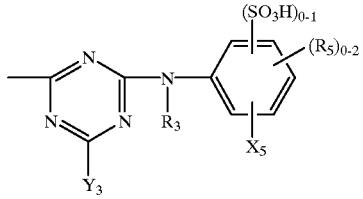

wherein $R_3$ is hydrogen or $C_1$–$C_4$alkyl, $R_4$ is phenylamino which is unsubstituted or substituted in the phenyl ring by $C_1$–$C_4$alkyl, $C_1$–$C_4$alkoxy, nitro, halogen or sulfo, $(R_5)_{0-2}$ is 0 to 2 identical or different substituents selected from the group consisting of $C_1$–$C_4$alkyl and $C_1$–$C_4$alkoxy, $X_5$ is a fibre-reactive radical of formula (3a), (3b), (3c) or (3d), and $Y_3$ is halogen, and (6)

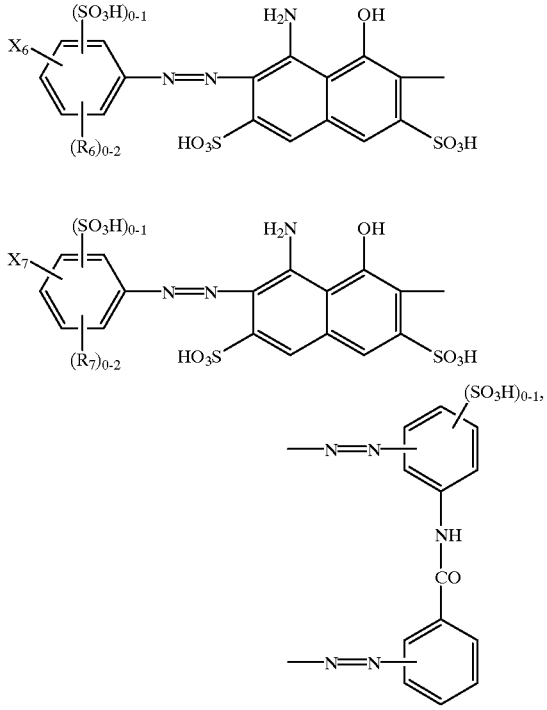

wherein $(R_6)_{0-2}$ and $(R_7)_{0-2}$ are each independently of one another 0 to 2 identical or different substituents selected from the group consisting of $C_1$–$C_4$alkyl and $C_1$–$C_4$alkoxy, and $X_6$ and $X_7$ are each independently of the other a fibre-reactive radical of formula (3a), (3b), (3c) or (3d), with the proviso that the dye mixtures do not contain any substantial amount of a reactive dye of formula (7)

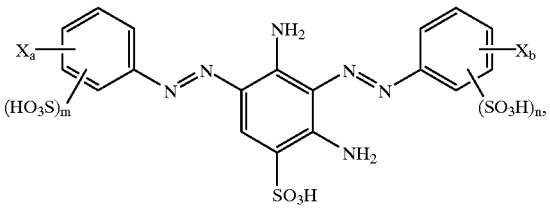

wherein $X_a$ and $X_b$ are each independently of the other α,β-dibromopropionylamino or β-sulfatoethylsulfonyl, and the sum of m and n is 0 or 1, if the dye mixtures comprise a dye of formula (8)

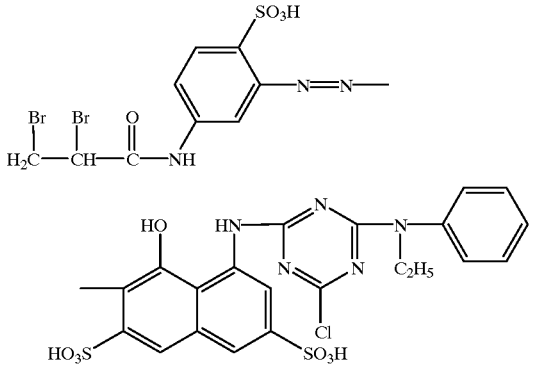

together with at least one of the two dyes of formula (4), wherein p and q are each 0, $(R_1)_{0-2}$ and $(R_2)_{0-2}$ are hydrogen, and $X_2$ and $X_3$ are β-sulfatoethylsulfonyl, or wherein p and q are each 1, $(R_1)_{0-2}$ and $(R_2)_{0-2}$ are hydrogen, and $X_2$ and $X_3$ are α,β-dibromopropionylamino, $D_3$ and $D_4$ of the dyes of formula (4) being benzene radicals.

In the dye mixtures of this invention, B is typically phenylene which is unsubsttuted or substituted by $C_1$–$C_4$alkyl, $C_1$–$C_4$alkoxy, $C_2$–$C_4$alkanoylamino, amino or halogen, B is preferably unsubstituted phenylene.

$D_1$ and $D_2$ in the inventive dye mixtures are unsubstituted or substituted.

Suitable substituents for $D_1$ or $D_2$ are the customary substituents for azo dyes. Illustrative examples are the following: $C_1$–$C_4$alkyl, meaning methyl, ethyl, n- or isopropyl, n-, iso-, sec- or tert-butyl; $C_1$–$C_4$alkoxy, meaning methoxy, ethoxy, n- or isopropoxy or n-, iso-, sec- or tert-butoxy; hydroxy-$C_1$–$C_4$alkoxy; phenoxy; $C_2$–$C_6$alkanoylamino which is unsubstituted or substituted in the alkyl moiety by hydroxy or $C_1$–$C_4$alkoxy, for example acetylamino, hydroxyacetylamino, methoxyacetylamino or propionylamino; benzoylamino which is unsubstituted or substituted in the phenyl moiety by hydroxy, sulfo, halogen, $C_1$–$C_4$alkyl or $C_1$–$C_4$alkoxy; $C_2$–$C_6$alkoxycarbonylamino which is unsubstituted or substituted in the alkyl moiety by hydroxy, $C_1$–$C_4$alkyl or $C_1$–$C_4$alkoxy; phenoxycarbonylamino which is unsubstituted or substituted in the phenyl moiety by hydroxy, $C_1$–$C_4$alkyl or $C_1$–$C_4$alkoxy; amino; N—$C_1$–$C_4$alkyl- or N,N-di-$C_1$–$C_4$alkylamino, each of which is unsubstituted or substituted in the alkyl moiety by hydroxy, $C_1$–$C_4$alkoxy, carboxy, cyano, halogen, sulfo, sulfato, phenyl or sulfophenyl, for example methylamino, ethylamino, N,N-dimethylamino, N,N-diethylamino, β-cyanoethylamino, β-hydroxyethylamino, N,N-di-β-hydroxyethylamino, β-sulfoethylamino, γ-sulfo-n-propylamino, β-sulfatoethylamino, N-ethyl-N-(3-sulfobenzyl)amino, N-(β-sulfoethyl)-N-benzylamino; cyclohexylamino; N-phenylamino or N—$C_1$–$C_4$alkyl-N-phenylamino, each of which is unsubstituted or substituted in the phenyl moiety by nitro, $C_1$–$C_4$alkyl, $C_1$–$C_4$alkoxy, carboxy, halogen or sulfo; $C_2$–$C_4$alkoxycarbonyl, for example methoxy- or ethoxycarbonyl; trifluoromethyl; nitro; cyano; halogen, generally meaning e.g. fluoro, bromo or, in particular, chloro; ureido; hydroxy; carboxy; sulfo; sulfomethyl; carbamoyl; carbamido; sulfamoyl; N-phenylsulfamoyl or N—$C_1$–$C_4$alkyl-N-phenylsulfamoyl, each of which is unsubstituted or substituted in the phenyl moiety by sulfo or carboxy; methyl- or ethylsulfonyl.

Other suitable substituents of $D_1$ or $D_2$ are fibre-reactive radicals.

Fibre-reactive radicals are, for example, an alkanoyl or alkylsulfonyl radical which is substituted by a removable atom or by a removable group, an alkenoyl or alkenesulfonyl radical which may be substituted by a removable atom or by a removable group, or a vinyl group-containing alkenoyl or alkenesulfonyl radical. The cited alkanoyl, alkylsulfonyl and alkenesulfonyl radicals usually contain 2 to 8 carbon atoms, and the alkenoyl radicals usually contain 3 to 8 carbon atoms. Also to be mentioned are radicals containing carbo- or heterocyclic 4-, 5- or 6-rings substituted by a removable atom or a removable group. Suitable heterocyclic radicals are, for example, those containing at least one removable substituent bound to a heterocyclic radical; inter alia those containing at least one reactive substituent bound to a 5- or 6-membered heterocyclic ring, e.g. bound to a monoazine, diazine, triazine, pyridine, pyrimidine, pyridazine, pyrazine, thiazine, oxazine or asymmetrical or symmetrical triazine ring, or to such a ring system containing one or several aromatic rings fused thereto, for example a quinoline, phthalazine, quinazoline, quinoxaline, acridine, phenazine and phenanthridine ring system.

Removable atoms or groups are, among others, for example halogen, such as fluoro, chloro or bromo, ammonium, induding hydrazinium, sulfato, thiosulfato, phosphato, acetoxy, propionoxy, azido, carboxypyridinium or rhodanido.

The fibre-reactive radical and the dye radical can be joined by a linking group. In addition to the direct bond or e.g. an amino group, widely different radicals are suitable as linking groups. The linking group is, for example, an aliphatic, aromatic or heterocyclic radical, but may also be composed of different such radicals. The linking group usually contains at least one functional group, e.g. the carbonyl group or the amino group, the amino group possibly being further substituted by $C_1$–$C_4$alkyl which may be substituted by halogen, hydroxy, cyano, $C_1$–$C_4$alkoxy, $C_1$–$C_4$alkoxycarbonyl, carboxy, sulfamoyl, sulfo or sulfato. The aliphatic radical can be, for example, an alkylene radical containing 1 to 7 carbon atoms or the branched isomers thereof. The carbon chain of the alkylene radical can be interrupted by a hetero atom, for example by an oxygen atom. The aromatic radical may be, for example, a phenyl radical which may be interrupted by $C_1$–$C_4$alkyl, such as methyl or ethyl, $C_1$–$C_4$alkoxy, such as methoxy or ethoxy, halogen, such as fluoro, bromo or, preferably, chloro, carboxy or sulfo, and the heterocyclic radical may be, for example, a piperazine radical.

Such fibre-reactive radicals are known per se and are described in great number, for example in Venkataraman "The Chemistry of Synthetic Dyes", Vol. 6, pages 1–209, Academic Press, New York, London 1972, or in EP-A-625, 549 and U.S. Pat. No. 5,684,138.

$D_1$ and $D_2$ are preferably each independently of the other phenyl or naphthyl, each of which is unsubstituted or substituted by $C_1$–$C_4$alkyl, $C_1$–$C_4$alkoxy, $C_2$–$C_4$alkanoylamino, sulfo or by a fibre-reactive radical of formula (3a), (3b), (3c) or (3d), preferably a phenyl radical which is unsubstituted or substituted as indicated above.

$D_1$ and $D_2$ are particularly preferably each independently of the other phenyl which is unsubstituted or substituted by sulfo or by a fibre-reactive radical of formula (3a) or (3b). The phenyl radical $D_1$ and D2 is preferably substituted by sulfo and by a radical of formula (3a) or (3b).

In the inventive dye mixtures, V is typically amino; phenylamino or N—$C_1$–$C_4$alkyl-N-phenylamino, each of which is unsubstituted or substituted in the phenyl ring by $C_1$–$C_4$alkyl, such as methyl or ethyl, by $C_1$–$C_4$alkoxy, such as methoxy or ethoxy, by $C_2$–$C_4$alkanoylamino, such as acetylamino or propionylamino, by hydroxy, carboxy, sulfo or halogen, such as chloro or bromo, preferably chloro, for example N-methyl-N-phenylamino or N-ethyl-N-phenylamino; N-mono- or N,N-di-$C_1$–$C_4$alkylamino, each of which is unsubstituted or substituted in the alkyl moiety by $C_2$–$C_4$alkanoylamino, such as acetylamino or propionylamino, by $C_1$–$C_4$alkoxy, such as methoxy or ethoxy, hydroxy, sulfo, sulfato or carboxy, for example N-methylamino, N-ethylamino, N-propylamino, N,N-dimethylamino or N,N-diethylamino, N-β-hydroxyethylamino and N,N-di-β-hydroxyethylamino; $C_5$–$C_7$cycloalkylamino which is unsubstituted or substituted in the cydoalkyl ring by $C_1$–$C_4$alkyl, such as methyl or ethyl, preferably methyl, or heterocycles which optionally contain further hetero atoms, for example morpholino or piperidin-1-yl.

V is preferably phenylamino or N—$C_1$–$C_4$alkyl-N-phenylamino, each of which is unsubstituted or substituted in the phenyl ring by $C_1$–$C_4$alkyl, $C_1$–$C_4$alkoxy, $C_2$-$C_4$alkanoylamino, halogen or sulfo.

V is particularly preferably phenylamino or N—$C_1$–$C_4$alkyl-N-phenylamino, each of which is unsubstituted or substituted in the phenyl ring by sulfo, preferably phenylamino or N—$C_1$–$C_4$alkyl-N-phenylamino and, more preferably, N-ethyl-N-phenylamino.

Hal in the fibre-reactive radicals of formulae (3a) and (3b) is preferably chloro or bromo, more preferably bromo.

$Y_1$ and $Y_3$ in the dyes of formulae (2) and (5), and $Y_2$ in the fibre-reactive radical of formula (3e), are each independently of one another fluoro, chloro or bromo, preferably chloro.

$R_1$, $R_2$, $R_4$, $R_5$, $R_6$ and $R_7$ defined as $C_1$–$C_4$alkyl are each independently of one another typically methyl, ethyl, propyl, isopropyl, butyl, sec-butyl, tert-butyl or isobutyl, preferably methyl or ethyl and, more preferably, methyl.

$R_3$ defined as $C_1$–$C_4$alkyl is typically methyl, ethyl, propyl, isopropyl, butyl, sec-butyl, tert-butyl or isobutyl, preferably methyl or ethyl.

$R_1$, $R_2$, $R_4$, $R_5$, $R_6$ and $R_7$ defined as $C_1$–$C_4$alkoxy are each independently of one another typically methoxy, ethoxy, propoxy, isopropoxy, butoxy or isobutoxy, preferably methoxy or ethoxy and, more preferably, methoxy.

In the dye mixtures of this invention, $D_3$ and $D_4$ of the reactive dye of formula (4) are preferably benzene radicals.

p and q are preferably each independently of the other 0 or 1.

Suitable leaving groups U in the fibre-reactve radicals of formula (3c), (3d) or (3e) are, for example, —Cl, —Br, —F, —$OSO_3H$, —$SSO_3H$, —OCO—$CH_3$, —$OPO_3H_2$, —OCO—$C_6H_5$, —$OSO_2$—$C_1$–$C_4$alkyl or —$OSO_2$—N($C_1$–$C_4$alkyl)$_2$. U is preferably a group of formula —Cl, —$OSO_3H$, —$SSO_3H$, —OCO—$CH_3$, —OCO—$C_6H_5$ or —$OPO_3H_2$, more preferably a group of formula —Cl or —$OSO_3H$ and, particularly preferably, a group of formula —$OSO_3H$.

$X_3$ and $X_4$ in the reactive dye of formula (4) are preferably each independently of the other a radical of formula (3a), (3b), (3c) or (3e), in particular of formula (3a), (3b) or (3c). If $X_3$ and $X_4$ are each a fibre-reactive radical of formula (3a) or (3b), then Hal is preferably bromo.

$R_3$ defined as $C_1$–$C_4$alkyl in the reactive dye of formula (5) is suitably e.g. methyl, ethyl, propyl, isopropyl, butyl, sec-butyl, tert-butyl or isobutyl, preferably methyl or ethyl.

$R_3$ in the reactive dye of formula (5) is preferably hydrogen.

$R_4$ defined as phenylamino in the reactive dye of formula (5) is unsubstituted or substituted in the phenyl ring by $C_1$–$C_4$alkyl, such as methyl or ethyl, $C_1$–$C_4$alkoxy, such as methoxy or ethoxy, nitro, halogen or sulfo. $R_4$ is preferably phenylamino which is unsubstituted in the phenyl ring.

$R_4$ is preferably bound in para-position to the azo group.

$R_5$ in the reactive dye of formula (5) is preferably hydrogen.

$X_5$ in the reactive dye of formula (5) is preferably a fibre-reactive radical of formula (3c) or (3d).

A suitable reactive dye of formula (5) is, for example, a dye of formula (5a)

(5a)

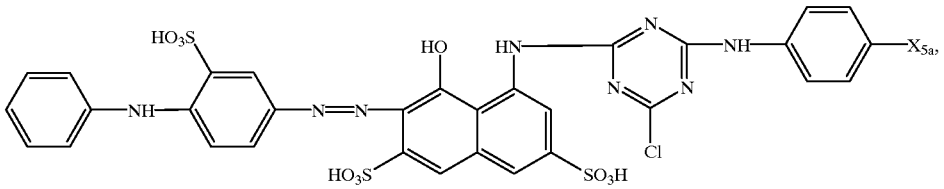

wherein $X_{5a}$ is β-sulfatoethylsulfonyl, vinyl sulfonyl or a fibre-reactive radical of formula (3d), wherein Z has the above meanings and U is —Cl or —$OSO_3H$.

$X_6$ and $X_7$ in the reactive dye of formula (6) are preferably each independently of the other a radical of formula (3a), (3b) or (3c), preferably of formula (3c). If $X_6$ and $X_7$ are each a fibre-reactive radical of formula (3a) or (3b), then Hal is preferably bromo.

$R_6$ and $R_7$ in the reactive dye of formula (6) are preferably hydrogen.

A suitable reactive dye of formula (6) is, for example, a dye of formula (6a)

(6a)

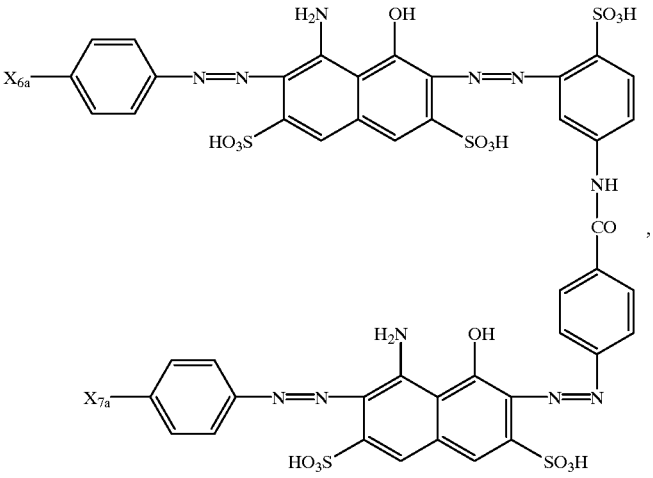

wherein $X_{6a}$ and $X_{7a}$ are each independently of the other β-sulfatoethylsulfonyl or vinyl sulfonyl.

The dye mixtures of this invention preferably comprise at least one reactive dye of formulae (1) and (2) together with at least one reactive dye of formula (4).

The dye mixtures of this invention particularly preferably comprise at least one reactive dye of formulae (1a) and (2a)

(1a)

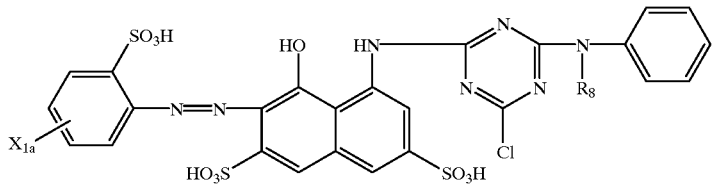

and (2a)

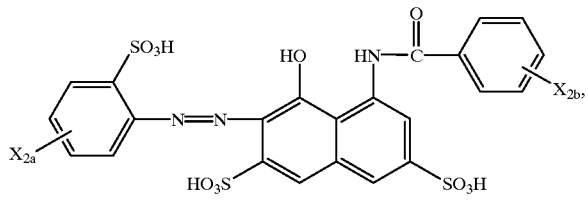

wherein $X_{1a}$, $X_{2a}$ and $X_{2b}$ are each independently of one another α,β-dibromopropionylamino or α-bromoacryloylamino, and $R_6$ is hydrogen, methyl or ethyl, preferably ethyl, together with at least one reactive dye of formulae (4a), (4b) and (4c), preferably of formula (4a), (4a)

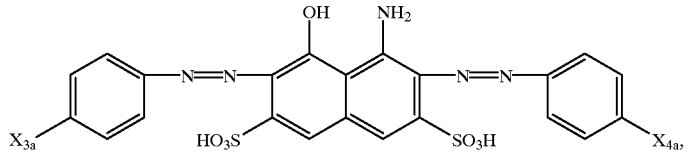

(4b)

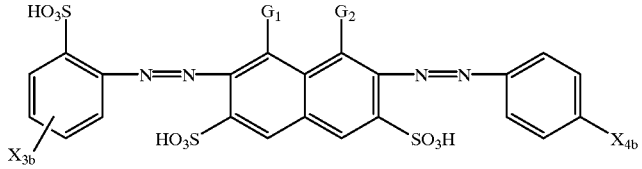

and (4c)

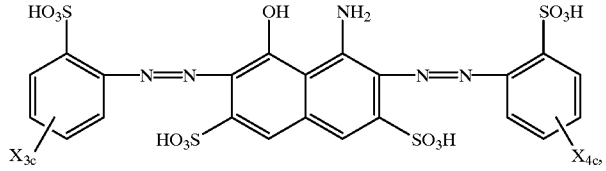

wherein one of the substituents $G_1$ and $G_2$ is amino and the other is hydroxy, $X_{3a}$, $X_{4a}$ and $X_{4b}$ are each independently of one another β-sulfatoethylsulfonyl or vinyl sulfonyl, and $X_{3b}$, $X_{3c}$ and $X_{4c}$ are each independently of one another α,β-dibromopropionylamino or α-bromoacryloylamino.

In the reactive dyes of formulae (1a) and (2a) the fibre-reactive radicals $X_{1a}$ and $X_{2a}$ are each independently of the other preferably in meta- or para-position, more preferably in meta-position, to the azo group. The fibre-reactive radical $X_{2b}$ in the reactive dye of formula (2a) is preferably in paraposition.

In the reactive dyes of formulae (4b) and (4c) the fibre-reactive radicals $X_{3b}$, $X_{3c}$ and $X_{4c}$ are each independently of one another preferably in meta- or para-position to the azo group.

In a particularly preferred embodiment of this invention, the novel dye mixtures additionally comprise at least one reactive dye of formula (9)

(9)

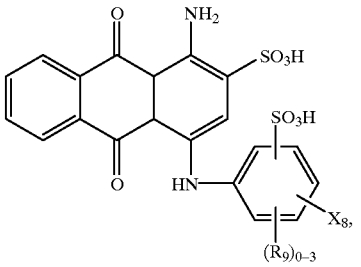

wherein $(R_9)_{0-3}$ is 0 to 3 identical or different substituents selected from the group consisting of $C_1$–$C_4$alkyl and $C_1$–$C_4$alkoxy, and $X_8$ is a radical of formula (3a) or (3b), preferably α,β-dibromopropionylamino or α-bromoacryloylamino and, more preferably, α-bromoacryloylamino.

$R_9$ defined as $C_1$–$C_4$alkyl is suitably, for example, methyl, ethyl, propyl, isopropyl, butyl, sec-butyl, tert-butyl or isobutyl, preferably methyl or ethyl and, more preferably, methyl.

$R_9$ defined as $C_1$–$C_4$alkoxy is suitably, for example, methoxy, ethoxy, propoxy, isopropoxy, butoxy or isobutoxy, preferably methoxy or ethoxy and, more preferably, methoxy.

$(R_9)_{0-3}$ is preferably 0 to 3 $C_1$–$C_4$alkyl radicals and, more preferably, 0 and 3 methyl radicals.

Suitable dye mixtures additionally comprising at least one reactive dye of formula (9) are, for example, those wherein the dye of formula (9) is a mixture of the reactive dyes of formulae (9a) and (9b)

(9a)

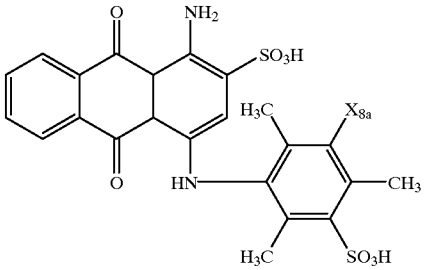

and (9b)

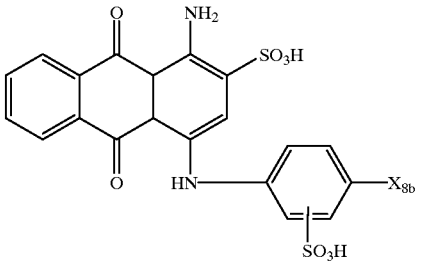

together with a reactive dye of formula (1a) and a reactive dye of formula (4c), or those wherein the dye of formula (9) is a reactive dye of formula (9a) together with a reactive dye of formula (1a) and with the reactive dyes of formulae (4a) and (4c), wherein $R_8$ is ethyl, $X_1$, $X_{3c}$, $X_{4c}$, $X_{8a}$ and $X_{8b}$ are each independently of one another α,β-dibromopropionylamino or α-bromoacryloylamino, and $X_{3a}$ and $X_{4a}$ are each independently of the other β-sulfatoethylsulfonyl or vinyl sulfonyl.

In addition to the above reactive dyes, the novel dye mixtures can comprise other dyes, in particular other reactive dyes, for shading.

Substantial amounts of reactive dyes of formula (7) are to be understood as meaning amounts of more than 5 percent by weight, based on the total weight of the dye mixture.

In a preferred embodiment of this invention, the novel dye mixtures do not contain any reactive dye of formula (7).

The reactive dyes of formulae (1), (2), (5), (6) and (9) are known or can be prepared in general analogy to known processes. Some of the reactive dyes of formula (4) are known. The reactive dyes on which the novel dye mixtures are based are described, inter alia, in U.S. Pat. No. 3,558,592, U.S. Pat. No. 5,554,733, U.S. Pat. No. 4,885,360 and U.S. Pat. No. 4,917,705.

The reactive dyes of formulae (1), (2), (4), (5), (6) and (9) comprise sulfo groups which are present either in the form of the free sulfonic acid or, preferably, as the salt thereof, e.g. as the sodium, lithium, potassium, ammonium salt or as salt of an organic amine, for example as triethanolammonium salt. The reactive dyes of formulae (1), (2), (4), (5), (6) and (9) and thus also the dye mixtures can contain additional additives, for example sodium chloride or dextrin.

In the dye mixture, the weight ratio of the dyes of formula (1) or (2) to the dyes of formula (4), (5) or (6) is, for example, 1:99 to 99:1, preferably 5:95 to 95:5 and, particularly preferably, 10:90 to 90:10.

The novel dye mixtures can be prepared, for example, by mixing the individual dyes. This mixing process is carried out, for example, in suitable mills, e.g. ball or pin mills, and also in kneaders or mixers.

The novel reactive dyes of formula (4) are also a subject matter of this invention. This invention thus relates to reactive dyes of formula (10)

(10)

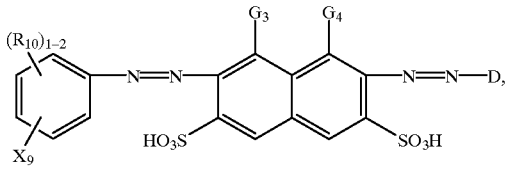

wherein

D is the radical of formula (11a)

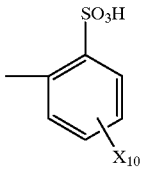

or (11b)

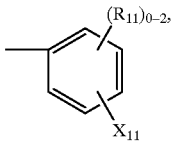

one of the substituents $G_3$ and $G_4$ is amino and the other is hydroxy, $(R_{10})_{1-2}$ is 1 to 2 identical or different substituents selected from the group $C_1$–$C_4$alkyl and $C_1$–$C_4$alkoxy, and $(R_{11})_{0-2}$ is 0 to 2 identical or different substituents selected from the group $C_1$–$C_4$alkyl and $C_1$–$C_4$alkoxy, $X_9$ and $X_{11}$ are each independently of the other β-sulfatoethylsulfonyl or vinyl sulfonyl, and $X_{10}$ is α,β-dibromopropionylamino or α-bromoacryloylamino.

$R_{10}$ and $R_{11}$ defined as $C_1$–$C_4$alkyl are each independently of the other typically methyl, ethyl, propyl, isopropyl, butyl, sec-butyl, tert-butyl or isobutyl, preferably methyl or ethyl and, more preferably, methyl.

$R_{10}$ and $R_{11}$ defined as $C_1$–$C_4$alkoxy are each independently of the other typically methoxy, ethoxy, propoxy, isopropoxy, butoxy or isobutoxy, preferably methoxy or ethoxy and, more preferably, methoxy.

In the reactive dye of formula (10) the fibre-reactive radicals $X_9$, $X_{10}$ and $X_{11}$ are each independently of one another preferably in meta- or para-position to the azo group.

In another of its aspects, this invention relates to a process for dyeing or printing hydroxyl group-containing or nitrogen-containing fibre materials with the novel dye mixtures or the novel reactive dyes of formula (10).

Suitable fibre materials are, for example, natural cellulosic fibres, such as coffon, linen, jute or hemp, as well as modified cellulosic fibres, such as cellulose or regenerated cellulose. The novel dye mixtures or dyes are particularly suitable for dyeing or printing natural polyamide fibre materials, for example silk or wool, synthetic polyamide fibre materials, e.g. polyamide 6 or polyamide 6.6, or blends of wool and synthetic polyamide. The novel dye mixtures or dyes are particularly suitable for dyeing or printing natural polyamide fibre materials, especially wool or wool which has been chlorinated or finished to be machine-washable.

The cited textile fibre material can be in a very wide range of forms of presentations, for example in the form of fibre, yam, loose stock, wovens or knits.

The novel dye mixtures or dyes are suitable for the customary dyeing and printing processes and may be applied and fixed to the fibre material in different manners, preferably in the form of aqueous dye solutions and printing pastes. The novel reactive dyes are suitable both for the exhaust process and for dyeing by the pad-dyeing process, in which the goods are impregnated with aqueous dye solutions which may contain salt, and the dyes are fixed after treatment with alkali, or in the presence of alkali, with or without the application of heat. The novel dye mixtures or dyes are also suitable for the so-called cold pad-batch method, which comprises applying the dye together with the alkali on the pad and subsequently fixing the dye by storing for severaly hours at room temperature.

The dyeing of natural and synthetic polyamide fibre materials, in particular of wool, is preferably carried out by the exhaust process at a pH of about 3 to 7, preferably of 3 to 5, and in the temperature range from e.g. 70 to 120° C. and, preferably, from 90 to 105° C.

In addition to water and the dyes of formulae (1), (2), (4), (5) or (6) or of formula (10) or (12), the dye liquors or printing pastes can contain further auxiliaries, for example per se known shading dyes, salts, buffer substances, wetting agents, antifoams, levelling agents or agents which influence the property of the textile materials, e.g. softeners, flame-proofing additives, or dirt, water and oil repellents, as well as water softeners and natural or synthetic thickeners, e.g. alginates and cellulose ethers.

The dye mixtures or dyes of this invention give level dyeings and prints having good allround fastness properties, in particular good fastness to washing, rubbing, wet treatment, wet rubbing and light. The novel dye mixtures or dyes are also distinguished by uniform colour build-up, good affinity and high degrees of fixation. When using the dye mixtures or dyes of this invention, the customary aftertreatment of the dyeings and prints with so-called fixing agents may furthermore be foregone.

In the following Examples, parts are parts by weight and temperatures are given in degrees Celsius. The relationship between parts by weight and parts by volume is the same as that between the gramme and the cubic centimetre.

WORKING EXAMPLE 1

24 parts of 1-amino-5-(α,β-dibromopropionylamino) benzene-2-sulfonic acid are suspended at about 20° C. in 176 parts of water with addition of 7 parts of sodium chloride, and this suspension is adjusted to pH 4.4. The suspension so obtained is then diazotised by adding 13.5 parts of hydrochloric acid (32%) and 15 parts of 4N sodium nitrite solution. After about 4 hours excess nitrite is destroyed with sulfaminic acid.

The above suspension of the diazo component is heated to about 10° C. and adjusted to pH 5. Over about 30 minutes the suspension is then run into a solution comprising 30 parts of the compound which, in the form of the free acid, corresponds to formula (101)

(101)

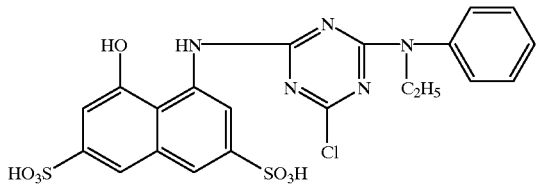

in 280 parts of water and which solution has a pH of 5, the pH being kept at 5 by adding an aqueous solution of sodium hydroxide. The reaction solution is then stirred at room temperature until diazonium saft can no longer be detected, and the product is salted out by addition of sodium chloride. The product is filtered, washed with an aqueous solution of sodium chloride and dried, giving a dye which, in the form of the free acid, corresponds to the compound of formula (102)

(102)

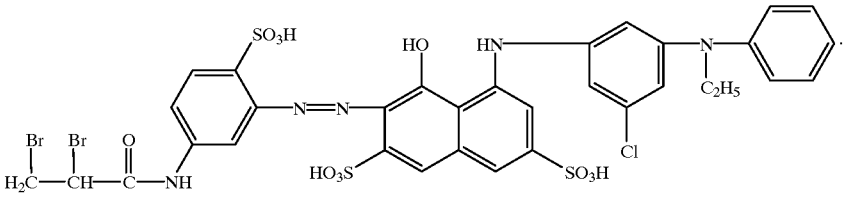

The dye of formula (102) dyes wool and polyamide in a red shade. The compound of formula (101) is obtained by condensing cyanuric chloride stepwise with 1-amino-8-hydroxynaphthalene-3,6-disulfonic acid and N-ethylaniline in analogy to the procedure described in U.S. Pat. No. 5,554,733.

WORKING EXAMPLE 2

A mixture of 28.1 parts of diazotised 1-amino-4-(β-sulfatoethylsulfonyl)benzene with 300 parts of water is added at 0 to 5° C. to 73.2 parts of the coupling component of formula (103)

(103)

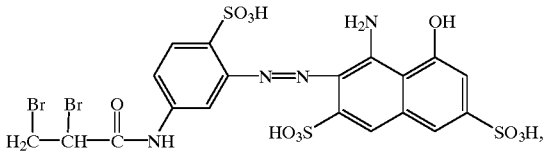

which is dissolved in 600 parts of water and which is prepared by acid coupling diazotised 1-amino-5-(α,β-dibromopropionylamino)benzene-2-sulfonic acid to 1-amino-8-hydroxynaphthalene-3,6-disulfonic acid. After completion of the coupling reaction at pH 5.5 to 6.5, the product is salted out by addition of sodium chloride. The product is filtered, washed with an aqueous solution of sodium chloride and dried, giving a dye which, in the form of the free acid, corresponds to the compound of formula (104)

(104)

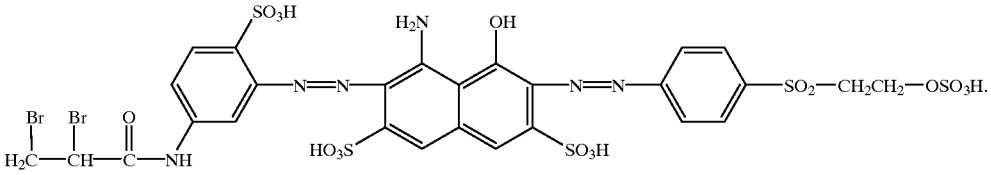

The dye of formula (104) dyes wool and polyamide in a blue shade.

WORKING EXAMPLES 3 to 7

The prodecure of Working Example 2 is repeated, but acid coupling first instead of 1-amino-5-(α,β-dibromopropionylamino)benzene-2-sulfonic acid the equivalent amount of the diazotised diazo component given in Table 1, column 2 under (i), to 1-amino-8-hydroxynaphthalene-3,6-disulfonic acid, and then to the monoazo compound so obtained instead of 1-amino-4-(β-sulfatoethylsulfonyl)benzene the equivalent amount of the diazotised diazo component given in Table 1, column 2 under (ii), which gives the reactive dyes listed in Table 1, column 3, which, in the form of the free acid, correspond to the compounds of the formulae given below and which dye wool and cellulose in blue shades.

TABLE 1

| Ex. | Diazo component | Dye of formula |
|---|---|---|
| 3 | (i) 1-amino-4-(β-sulfatoethylsulfonyl)benzene<br>(ii) 1-amino-4-(α,β-dibromopropionylamino)benzene-2-sulfonic acid | (105) |
| 4 | (i) 1-amino-4-(α,β-dibromopropionylamino)benzene-2-sulfonic acid<br>(ii) 1-amino-4-(β-sulfatoethylsulfonyl)benzene | (106) |
| 5 | (i) 1-amino-4-(α,β-dibromopropionylamino)benzene-2-sulfonic acid<br>(ii) 1-amino-3-methyl-4-(β-sulfatoethylsulfonyl)-6-methoxybenzene | (107) |
| 6 | (i) 1-amino-4-(α,β-dibromopropionylamino)benzene-2-sulfonic acid<br>(ii) 1-amino-3,6-dimethoxy-4-(β-sulfatoethylsulfonyl)benzene | (108) |
| 7 | (i) 1-amino-4-(α-bromacryloylamino)benzene-2-sulfonic acid<br>(ii) 1-amino-3,6-dimethoxy-4-(β-sulfatoethylsulfonyl)benzene | (109) |

(105)

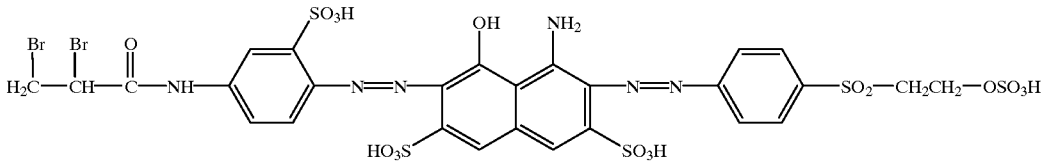

(106)

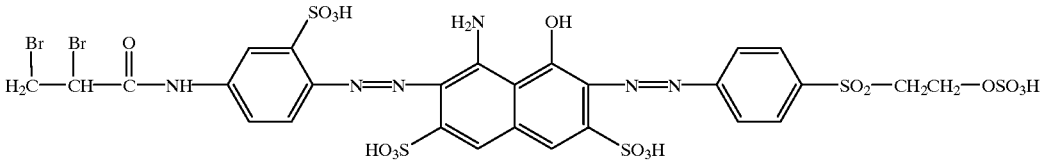

(107)

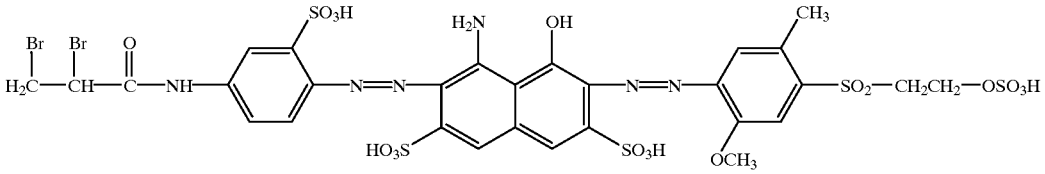

(108)

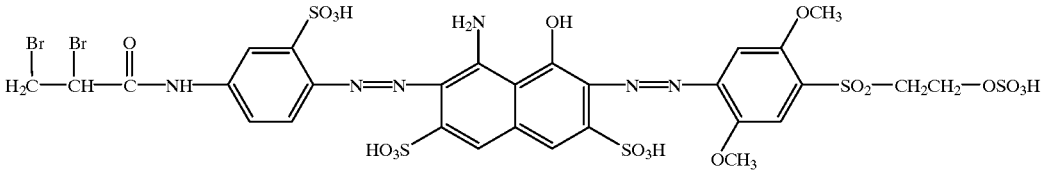

(109)

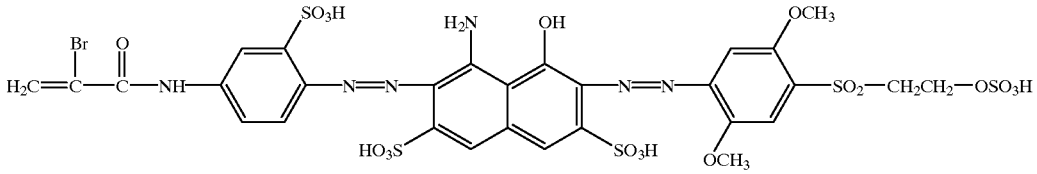

DYEING EXAMPLE 1

10 g of wool fabric are dyed in a laboratory dyeing apparatus with the following liquor:

0.1 g of sodium acetate, 0.2 g of a commercially available levelling agent (Albegal B®), 0.08 g of the red dye of formula (102), 0.32 g of the blue dye of formula (105), 200 ml of water, and a sufficient amount of 80% acetic acid, such that the pH of the liquor is 4.5.

The textile material is treated for 10 minutes at 40° C. in the dye liquor and is then heated to 70° C. at a heating rate of 1° C./min. The liquor is kept for 20 minutes at 70° C. and is then heated at a heating rate of 1° C./min to boiling temperature (98° C.) and dyed for 90 minutes at this temperature. After cooling the liquor to 70° C., the dyeing is rinsed and finished in customary manner, givng a fibre and surface level navy blue dyeing having good fastness properties.

DYEING EXAMPLES 2 to 6

The procedure of Dyeing Example 1 is repeated, but replacing 0.08 g of the red dye of formula (102) and 0.32 g of the blue dye of formula (105) with those amounts of these dyes which are indicated in the following Table 2, column 2, and with the indicated amounts of the other dyes listed there, which also gives fibre and surface level dyeings of the indicated shade and having good fastness properties.

TABLE 2

| Ex. | Dye mixture | Shade |
|---|---|---|
| 2 | 0.070 g of the red dye of formula (102),<br>0.245 g of the blue dye of formula (105) and<br>0.035 g of the dye of formula (110)<br> 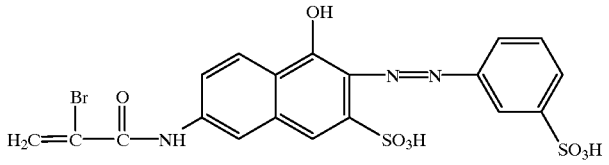 <br>(110) | navy blue |
| 3 | 0.070 g of the red dye of formula (102),<br>0.245 g of the blue dye of formula (105) and<br>0.035 g of the dye of formula (111)<br> 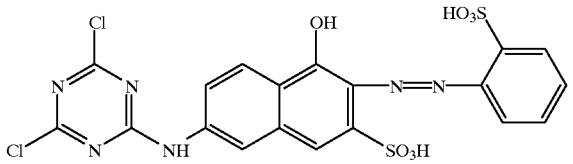 <br>(111) | navy blue |
| 4 | 0.08 g of the red dye of formula (102),<br>0.28 g of the blue dye of formula (105) and<br>0.04 g of the dye of formula (112)<br> 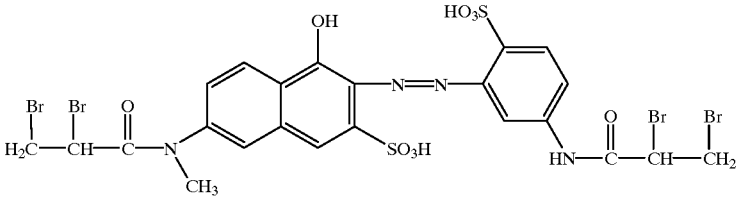 <br>(112) | navy blue |
| 5 | 0.070 g of the red dye of formula (102),<br>0.245 g of the blue dye of formula (105),<br>0.014 g of the dye of formula (113)<br> 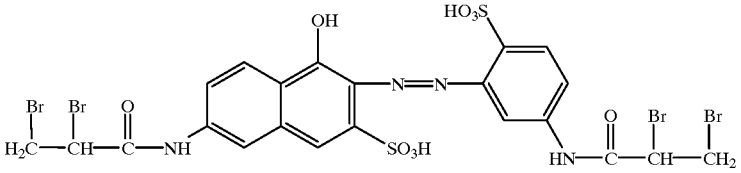 <br>(113) and<br>0.021 g of the dye of formula (114)<br> 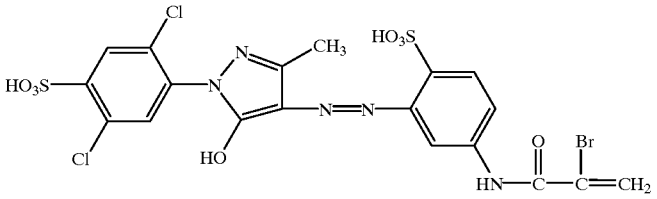 <br>(114) | navy blue |
| 6 | 0.05 g of the red dye of formula (102),<br>0.35 g of the blue dye of formula (105),<br>0.05 g of the dye of formula (110) and<br>0.05 g of the dye of formula (114). | black |

DYEING EXAMPLES 7 to 12

The procedure of the Dyeing Examples 1 to 6 is repeated, but replacing the blue dye of formula (105) with the blue dye of formula (115)

(115)

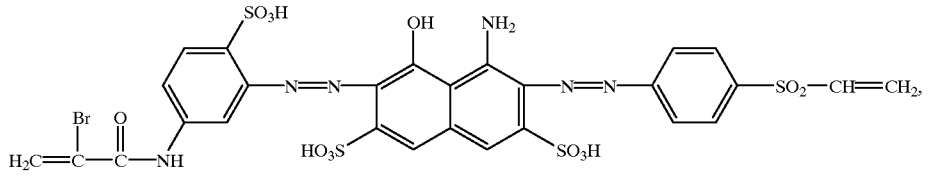

which also gives fibre and surface level dyeings in the shades indicated in Table 3, column 3, having good fastness properties.

TABLE 3

| Ex. | Dye mixture | Shade |
|---|---|---|
| 7 | 0.08 g of the red dye of formula (102) and 0.32 g of the blue dye of formula (115) | navy blue |
| 8 | 0.070 g of the red dye of formula (102), 0.245 g of the blue dye of formula (115) and 0.035 g of the dye of formula (110) | navy blue |
| 9 | 0.070 g of the red dye of formula (102), 0.245 g of the blue dye of formula (115) and 0.035 g of the dye of formula (111) | navy blue |
| 10 | 0.08 g of the red dye of formula (102), 0.28 g of the blue dye of formula (115) and 0.04 g of the dye of formula (112) | navy blue |
| 11 | 0.070 g of the red dye of formula (102), 0.245 g of the blue dye of formula (115), 0.014 g of the dye of formula (113) and 0.021 g of the dye of formula (114) | navy blue |
| 12 | 0.05 g of the red dye of formula (102), 0.35 g of the blue dye of formula (115), 0.05 g of the dye of formula (110) and 0.05 g of the dye of formula (114) | black |

DYEING EXAMPLES 13 to 18

The procedure of the Dyeing Examples 1 to 6 is repeated, but replacing the blue dye of formula (105) with the blue dye of formula (106), which also gives fibre and surface level dyeings in the shades listed in Table 4, column 3, having good fastness properties.

TABLE 4

| Ex. | Dye mixture | Shade |
|---|---|---|
| 13 | 0.08 g of the red dye of formula (102) and 0.32 g of the blue dye of formula (106) | navy blue |
| 14 | 0.070 g of the red dye of formula (102), 0.245 g of the blue dye of formula (106) and 0.035 g of the dye of formula (110) | navy blue |
| 15 | 0.070 g of the red dye of formula (102), 0.245 g of the blue dye of formula (106) and 0.035 g of the dye of formula (111) | navy blue |
| 16 | 0.08 g of the red dye of formula (102), 0.28 g of the blue dye of formula (106) and 0.04 g of the dye of formula (112) | navy blue |
| 17 | 0.070 g of the red dye of formula (102), 0.245 g of the blue dye of formula (106), 0.014 g of the dye of formula (113) 0.021 g of the dye of formula (114) | navy blue |
| 18 | 0.05 g of the red dye of formula (102), 0.35 g of the blue dye of formula (106), 0.05 g of the dye of formula (110) 0.05 g of the dye of formula (114) | black |

DYEING EXAMPLES 19 to 24

The procedure of the Dyeing Examples 1 to 6 is repeated, but replacing in each case the red dye of formula (102) with the red dye of formula (116)

(116)

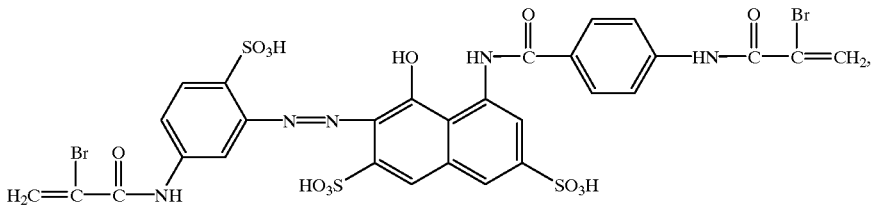

which also gives fibre and surface level dyeings in the shades listed in Table 5, column 3, having good fastness properties.

TABLE 5

| Ex. | Dye mixture | Shade |
|---|---|---|
| 19 | 0.08 g of the red dye of formula (116) and 0.32 g of the blue dye of formula (105) | navy blue |
| 20 | 0.070 g of the red dye of formula (116), 0.245 g of the blue dye of formula (105) and 0.035 g of the dye of formula (110) | navy blue |
| 21 | 0.070 g of the red dye of formula (116), 0.245 g of the blue dye of formula (105) and 0.035 g of the dye of formula (111) | navy blue |
| 22 | 0.08 g of the red dye of formula (116), 0.28 g of the blue dye of formula (105) and 0.04 g of the dye of formula (112) | navy blue |
| 23 | 0.070 g of the red dye of formula (116), 0.245 g of the blue dye of formula (105), 0.014 g of the dye of formula (113) and 0.021 g of the dye of formula (114) | navy blue |

TABLE 5-continued

| Ex. | Dye mixture | Shade |
|---|---|---|
| 24 | 0.05 g of the red dye of formula (116), 0.35 g of the blue dye of formula (105), 0.05 g of the dye of formula (110) and 0.05 g of the dye of formula (114) | black |

DYEING EXAMPLES 25 to 28

The procedure of Dyeing Example 1 is repeated, but replacing 0.08 g of the red dye of formula (102) and 0.32 9 of the blue dye of formula (105) with the indicated amounts of the cited dyes listed in the following Table 6, column 2, which also gives fibre and surface level dyeings in the indicated shades and having good fastness properties.

TABLE 6

| Ex. | Dye mixture | Shade |
|---|---|---|
| 25 | 0.08 g of the red dye of formula (102), 0.28 g of the blue dye of formula (117) | navy blue |

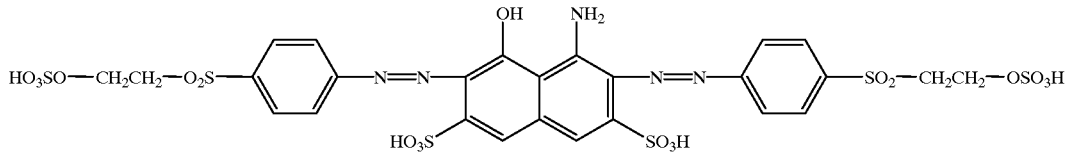

(117)

and 0.04 g of the blue dye of formula (118)

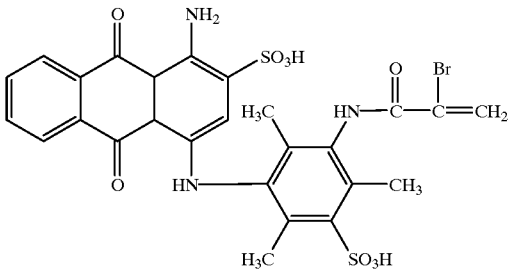

(118),

| | | |
|---|---|---|
| 26 | 0.08 g of the red dye of formula (116), 0.28 g of the blue dye of formula (117) and 0.04 g of the blue dye of formula (118) | navy blue |
| 27 | 0.067 g of the red dye of the formula (102), 0.200 g of the blue dye of formula (117), 0.044 g of the blue dye of formula (118) and 0.089 g of the blue dye of formula (119) | navy blue |

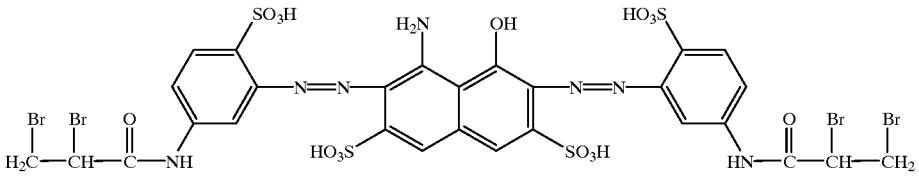

(119)

TABLE 6-continued

| Ex. | Dye mixture | Shade |
|---|---|---|
| 28 | 0.073 g of the red dye of formula (102),<br>0.036 g of the blue dye of formula (118),<br>0.270 g of the blue dye of formula (119) and<br>0.021 g of the blue dye of formula (120)<br> 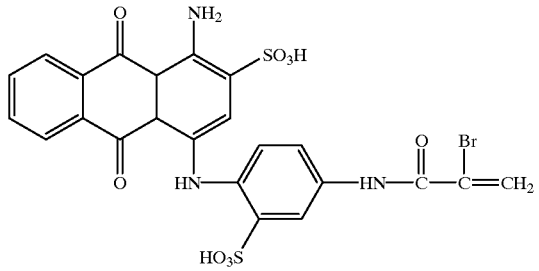 <br>(120), | navy blue |

DYEING EXAMPLE 29

The procedure of Dyeing Example 1 is repeated, but additionally adding 2% by weight, based on the textile material, of a commercial protective agent for wool (Irgasol HTW®) to the dyeing liquor, which also gives a fibre and surface level navy blue dyeing having good fastness properties.

DYEING EXAMPLE 30

100 parts of a cotton fabric are placed at 30° C. in a dye bath comprising 1.2 parts of the dye of formula (117), 1.2 parts of the dyes of formula (102), 3.6 parts of the dye of formula (121)

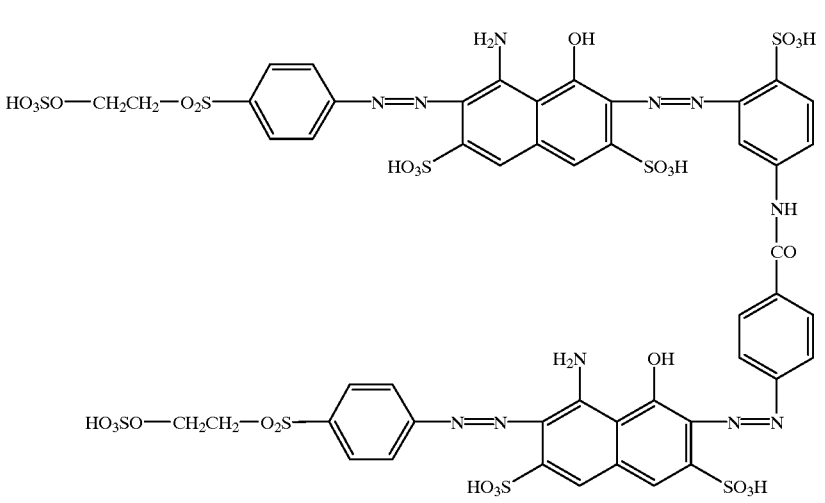

(121)

and 30 parts of sodium chloride in 1000 parts of water. The temperature of the dye bath is raised over 30 minutes to 90° C. and is kept there for another 45 minutes. The temperature is then lowered over about 15 minutes to 70° C. and 15 parts of calcined soda are added and the temperature of the dye bath is kept for another 45 minutes at 70° C. The dyed fabric is then rinsed and dried in customary manner. A fibre and surface level dyeing having good fastness properties is obtained.

DYEING EXAMPLE 31

100 parts of a cotton fabric are placed at 30° C. in a dye bath comprising 2.7 parts of the dye of formula (117), 0.9 part of the dye of formula (102), 2.4 parts of the dye of formula (122)

(122)

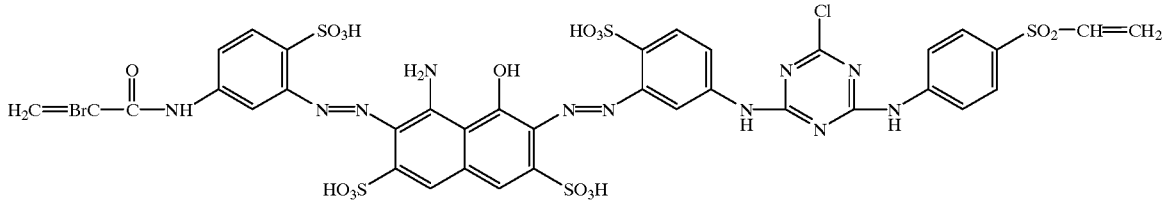

and 90 parts of sodium chloride in 1000 parts of water. The temperature of the dye bath is kept for 20 minutes and is then raised over about 40 minutes to 80° C. Subsequently, 20 parts of calined soda are added and the temperature of the dye bath is kept for another 45 minutes at 80° C. The dyed fabric is then rinsed and dried in customary manner. A fibre and surface level dyeing having good fastness properties is obtained.

What is claimed is:

1. A dye mixture, which comprises at least one reactive dye of formulae (1) and (2)

(1)

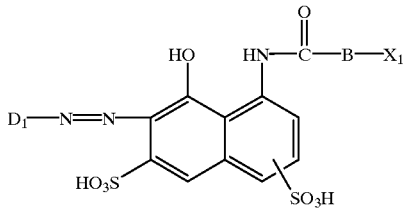

and (2)

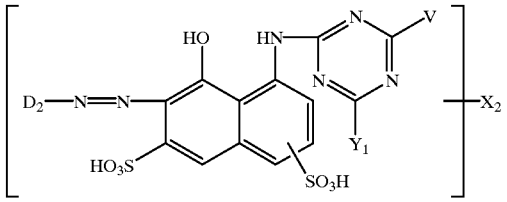

, wherein

B is a radical of the benzene series, $D_1$ and $D_2$ are each independently of the other a radical of the benzene or naphthalene series, V is unsubstituted or substituted amino, $X_1$ and $X_2$ are each independently of the other a fibre-reactive radical of formula —NH—CO—CH(Hal)—$CH_2$Hal (3a) or —NH—CO—C(Hal)=$CH_2$ (3b), wherein Hal is halogen, and $Y_1$ is halogen;

together with at least one reactive dye of formulae (4), (5) and (6)

(4)

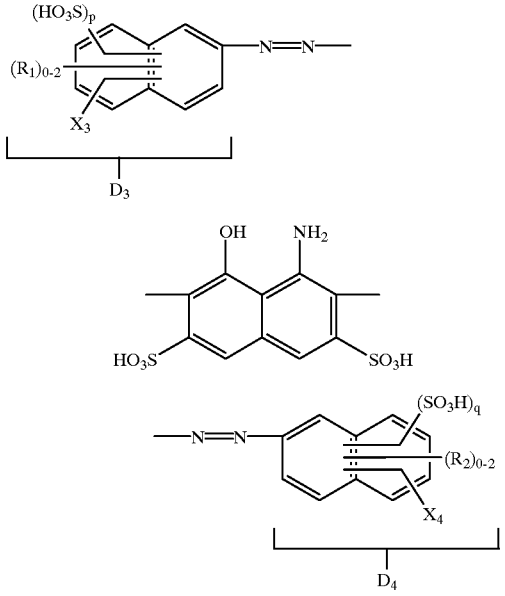

, wherein $(R_1)_{0-2}$ and $(R_2)_{0-2}$ are each independently of one another 0 to 2 identical or different substituents selected from the group consisting of $C_1$–$C_4$alkyl and $C_1$–$C_4$alkoxy, p and q are each independently of the other the number 0, 1 or 2, $X_3$ and $X_4$ are each independently of the other hydrogen or a fibre-reactive radical of formula (3a), (3b), (3c), (3d) or (3e)

(3a)

—NH—CO—CH(Hal)—$CH_2$Hal, (3b)

—NH—CO—C(Hal)=$CH_2$, (3c)

—$SO_2$—Z, (3d)

—CO—NH—$(CH_2)_{2-3}$—$SO_2$—Z or

-continued (3e)

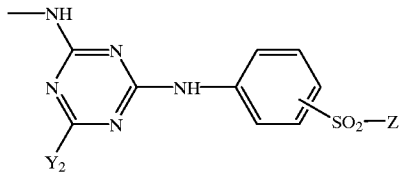

and Hal and $Y_2$ are halogen, Z is a radical of formula $—CH_2CH_2—U$ or $—CH=CH_2$, and U is a leaving group (5)

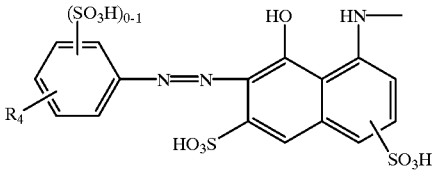

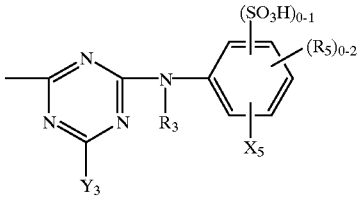

wherein $R_3$ is hydrogen or $C_1$–$C_4$alkyl, $R_4$ is phenylamino which is unsubstituted or substituted in the phenyl ring by $C_1$–$C_4$alkyl, $C_1$–$C_4$alkoxy, nitro, halogen or sulfo, $(R_5)_{0-2}$ is 0 to 2 identical or different substituents selected from the group consisting of $C_1$–$C_4$alkyl and $C_1$–$C_4$alkoxy, $X_5$ is a fibre-reactive radical of formula (3a), (3b), (3c) or (3d), and $Y_3$ is halogen, and (6)

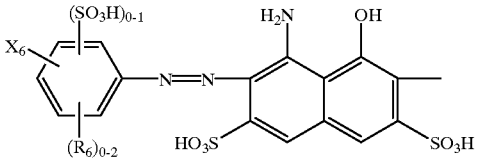

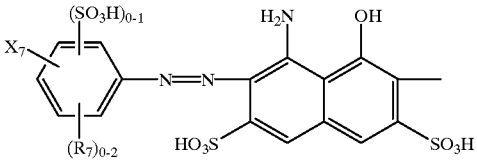

-continued

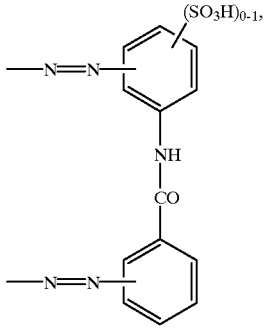

wherein $(R_6)_{0-2}$ and $(R_7)_{0-2}$ are each independently of one another 0 to 2 identical or different substituents selected from the group consisting of $C_1$–$C_4$alkyl and $C_1$–$C_4$alkoxy, and $X_6$ and $X_7$ are each independently of the other a fibre-reactive radical of formula (3a), (3b), (3c) or (3d), with the proviso that the dye mixtures do not contain any substantial amount of a reactive dye of formula (7)

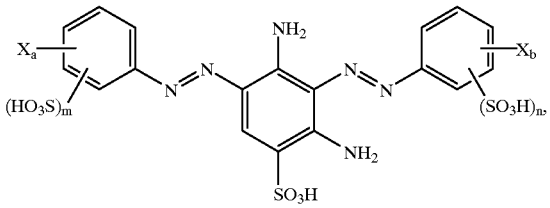

wherein $X_a$ and $X_b$ are each independently of the other α,β-dibromopropionylamino or β-sulfatoethylsulfonyl, and the sum of m and n is 0 or 1, if the dye mixtures comprise a dye of formula (8)

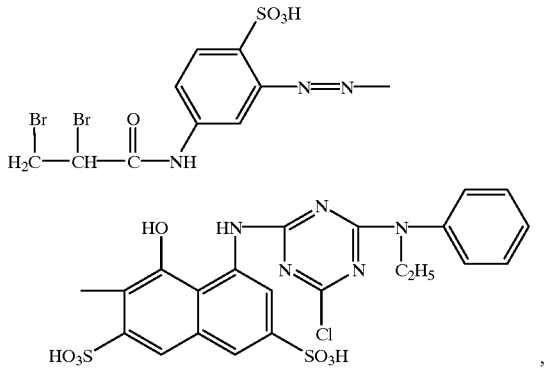

together with at least one of the two dyes of formula (4), wherein and q are each 0, $(R_1)_{0-2}$ and $(R_2)_{0-2}$ are hydrogen, and $X_2$ and $X_3$ are β-sulfatoethylsulfonyl, or wherein p and q are each 1, $(R_1)_{0-2}$ and $(R_2)_{0-2}$ are hydrogen, and $X_2$ and $X_3$ are α,β-dibromopropionylamino, $D_3$ and $D_4$ of the dyes of formula (4) being benzene radicals.

2. A dye mixture according to claim 1, wherein B is phenylene.

3. A dye mixture according to claim 1, wherein $D_1$ and $D_2$ are each independently of the other phenyl or naphthyl, each of which is unsubstituted or substituted by $C_1$–$C_4$alkyl, $C_1$–$C_4$alkoxy, $C_2$–$C_4$alkanoylamino, sulfo or by a fibre-reactive radical of formula (3a), (3b), (3c) or (3d).

4. A dye mixture according to claim 1, wherein $D_1$ and $D_2$ are each independently of the other phenyl which is unsubstituted or substituted by sulfo or by a fibre-reactive radical of formula (3a) or (3b).

5. A dye mixture according to claim 1, wherein V is phenylamino or N—$C_1$–$C_4$alkyl-N-phenylamino, each of which is unsubstituted or substituted in the phenyl ring by $C_1$–$C_4$alkyl, $C_1$–$C_4$alkoxy, $C_2$–$C_4$alkanoylamino, halogen or sulfo.

6. A dye mixture according to claim 1, wherein Hal is chloro or bromo.

7. A dye mixture according to claim 1, wherein $D_3$ and $D_4$ are benzene radicals.

8. A dye mixture according to claim 1, wherein U is —Cl, —Br, —F, —$OSO_3H$, —$SSO_3H$, —OCO—$CH_3$, —$OPO_3H_2$, —OCO—$C_6H_5$, —$OSO_2$—$C_1$–$C_4$alkyl or —$OSO_2$—N($C_1$–$C_4$alkyl)$_2$.

9. A dye mixture according to claim 1, wherein U is —Cl or —$OSO_3H$.

10. A dye mixture according to claim 1, wherein $Y_1$ and $Y_2$ are each independently of the other fluoro, chloro or bromo.

11. A dye mixture according to claim 1, wherein $X_3$ and $X_4$ are each independently of the other a fibre-reactive radical of formula (3a), (3b), (3c) or (3e).

12. A dye mixture according to claim 1, wherein $X_6$ and $X_7$ are each independently of the other a fibre-reactive radical of formula (3a), (3b) or (3c).

13. A dye mixture according to claim 1, which comprises at least one reactive dye of formulae (1) and (2) together with at least one reactive dye of formula (4).

14. A dye mixture according to claim 1, which comprises at least one reactive dye of formulae (1a) and (2a)

(1a)

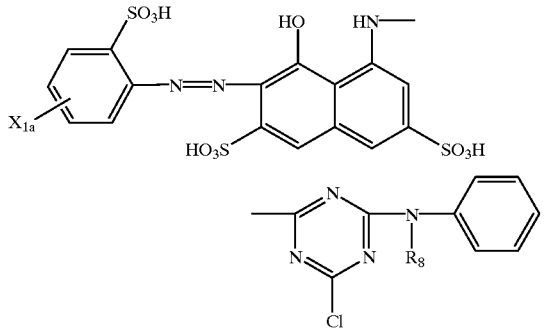

and (2a)

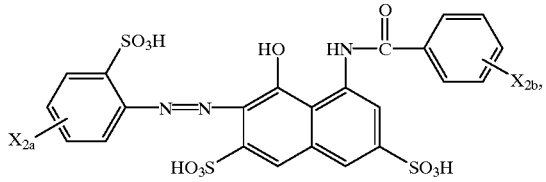

wherein $X_{1a}$, $X_{2a}$ and $X_{2b}$ are each independently of one another α,β-dibromopropionylamino or α-bromoacryloylamino, and $R_8$ is hydrogen, methyl or ethyl, together with at least one reactive dye of formula (4a), (4b) and (4c)

(4a)

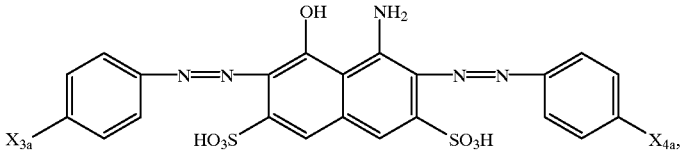

(4b)

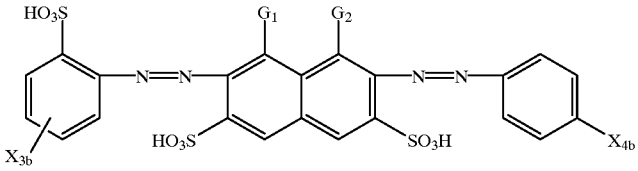

and

-continued (4c)

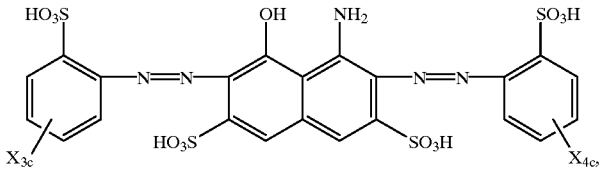

wherein one of the substituents $G_1$ and $G_2$ is amino and the other is hydroxy, $X_{3a}$, $X_{4a}$ and $X_{4b}$ are each independently of one another β-sulfatoethylsulfonyl or vinyl sulfonyl, and $X_{3b}$, $X_{3c}$ and $X_{4c}$ are each independently of one another α,β-dibromopropionylamino or α-bromoacryloylamino.

15. A dye mixture according to claim 14, which comprises at least one reactive dye of formulae (1a) and (2a) together with at least one reactive dye of formula (4a).

16. A dye mixture according to claim 1, which additionally comprises at least one reactive dye of formula (9)

(9)

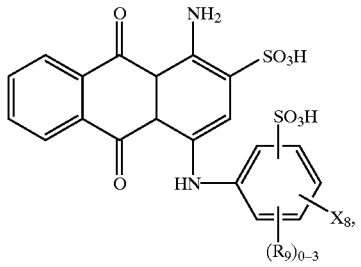

wherein $(R_9)_{0-3}$ is 0 to 3 identical or different substituents selected from the group consisting of $C_1$–$C_4$alkyl and $C_1$–$C_4$alkoxy, and $X_8$ is a radical of formula (3a) or (3b).

17. A dye mixture according to claim 16, wherein $(R_9)_{0-3}$ is 0 to 3 methyl radicals, and $X_8$ is α,β-dibromopropionylamino or α-bromoacryloylamino.

18. A process for dyeing or printing hydroxyl group-containing or nitrogen-containing fibre material, which comprises applying thereto a dye mixture as claimed in claim 1.

19. A process according to claim 18, wherein the fibre material is natural or synthetic polyamide fibre material.

20. A process according to claim 18, wherein the fibre material is cellulosic fibre material.

* * * * *

UNITED STATES PATENT AND TRADEMARK OFFICE

CERTIFICATE OF CORRECTION

PATENT NO. : 5, 989,298

DATED : NOVEMBER 23, 1999

INVENTOR(S) : URS LEHMANN ET AL.

It is certified that error appears in the above-identified patent and that said Letters Patent is hereby corrected as shown below:

On the title page, Section [30] should read:

-- [30] Foreign Application Priority Data

| | | | |
|---|---|---|---|
| Apr. 7, 1997 | [CH] | Switzerland | 806/97 |
| Jun. 30, 1998 | | EPO | 98810607.6 --. |

Signed and Sealed this

First Day of August, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 5,989,298
DATED : November 23, 1999
INVENTOR(S) : Urs Lehmann et al.

It is certified that error appears in the above-identified patent and that said Letters Patent is hereby corrected as shown below:

Column 28,
Lines 15-40, the Formula should read:

–

(4)

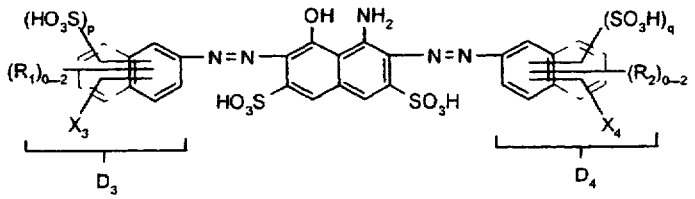

–.

Column 30,
Line 66, should read -- $X_3$ and $X_4$ are β-sulfatoethylsulfonyl, or wherein --

Column 31,
Line 3, should read -- $X_3$ and $X_4$ are α.β-dibromopropionylamino, --.

Signed and Sealed this

Twelfth Day of March, 2002

*Attest:*

*Attesting Officer*

JAMES E. ROGAN
*Director of the United States Patent and Trademark Office*